US006032707A

United States Patent [19]

Morey et al.

[11] Patent Number: 6,032,707

[45] Date of Patent: Mar. 7, 2000

[54] DRUM ASSEMBLY FOR A WOOD CHIPPER

[75] Inventors: Michael Boyd Morey, Shepherd; Michael John Peterman, Alma; Brian Lee Bloomquist, St. Louis, all of Mich.

[73] Assignee: Tramor, Inc., Remus, Mich.

[21] Appl. No.: 09/218,491

[22] Filed: Dec. 22, 1998

[51] Int. Cl.[7] ..... B27C 1/00

[52] U.S. Cl. ..... 144/174; 144/162.1; 144/172; 144/373; 241/93; 241/273.3; 241/191

[58] Field of Search ..... 144/162.1, 172, 144/173, 174, 373; 241/83, 189.1, 191, 277, 93, 91, 273.3

[56] References Cited

U.S. PATENT DOCUMENTS

| | | | |
|---|---|---|---|
| 190,675 | 5/1877 | Gaines . | |
| 589,236 | 8/1897 | Williams . | |
| 604,283 | 5/1898 | Albrecht . | |
| 1,266,894 | 5/1918 | Williams . | |
| 1,713,507 | 5/1929 | Ammon . | |
| 1,752,290 | 4/1930 | Ammon . | |
| 1,889,129 | 11/1932 | Nielsen . | |
| 2,026,790 | 1/1936 | Mankoff | 83/11 |
| 2,128,194 | 8/1938 | Sheldon | 83/11 |
| 2,244,577 | 6/1941 | Schreiber | 83/11 |
| 2,318,219 | 5/1943 | Harris | 83/11 |
| 2,392,958 | 1/1946 | Tice | 241/55 |
| 2,663,505 | 12/1953 | Sennholtz | 241/197 |
| 2,710,635 | 6/1955 | Alexander | 144/162 |
| 2,863,476 | 12/1958 | Clark | 144/172 |
| 2,864,420 | 12/1958 | Schmidt | 146/106 |
| 3,254,687 | 6/1966 | Tertyshnikov | 146/79 |
| 3,367,585 | 2/1968 | Ratkowski | 241/197 |
| 3,436,028 | 4/1969 | Koehnen et al. | 241/186 |
| 3,509,924 | 5/1970 | Newhouse, Jr. | 146/70.1 |
| 3,642,214 | 2/1972 | Blackwell, Jr. | 241/191 |
| 3,844,494 | 10/1974 | Hightower | 241/197 |
| 3,907,016 | 9/1975 | Nicholson et al. | 144/172 |
| 4,074,594 | 2/1978 | Dall et al. | 76/101 |
| 4,077,450 | 3/1978 | Ackerman | 144/172 |
| 4,117,985 | 10/1978 | Lazareck | 241/197 |
| 4,129,260 | 12/1978 | Baker | 241/46 |
| 4,146,184 | 3/1979 | Whitney | 241/73 |
| 4,162,769 | 7/1979 | Lapointe | 241/68 |
| 4,168,035 | 9/1979 | Palm et al. | 241/81 |
| 4,504,019 | 3/1985 | Newell et al. | 241/73 |
| 4,702,424 | 10/1987 | Widlak | 241/101.7 |
| 4,717,083 | 1/1988 | Quast et al. | 241/197 |
| 4,850,406 | 7/1989 | Krautzberger | 144/230 |
| 4,872,500 | 10/1989 | Duffey et al. | 164/34 |
| 4,915,310 | 4/1990 | Stelk | 241/197 |
| 4,917,314 | 4/1990 | Manschwetus | 241/194 |
| 4,922,977 | 5/1990 | Colton et al. | 144/230 |
| 4,967,969 | 11/1990 | Griffith, III | 241/93 |
| 4,982,904 | 1/1991 | Greiner | 241/73 |
| 5,005,620 | 4/1991 | Morey | 144/174 |
| 5,042,727 | 8/1991 | Plante | 241/101.7 |
| 5,044,567 | 9/1991 | Hte et al. | 241/73 |
| 5,078,328 | 1/1992 | Willingham | 241/101.7 |
| 5,114,085 | 5/1992 | Inui | 241/195 |
| 5,205,496 | 4/1993 | O'Donnell et al. | 241/34 |
| 5,209,278 | 5/1993 | Carpenter et al. | 144/230 |
| 5,285,974 | 2/1994 | Cesarini | 241/194 |
| 5,362,004 | 11/1994 | Bateman | 241/290 |
| 5,372,316 | 12/1994 | Bateman | 241/191 |
| 5,377,919 | 1/1995 | Rogers et al. | 241/189.2 |
| 5,413,286 | 5/1995 | Bateman | 241/190 |
| 5,474,239 | 12/1995 | Williams, Jr. et al. | 241/73 |
| 5,526,988 | 6/1996 | Rine | 241/23 |
| 5,692,548 | 12/1997 | Bouwers et al. | 144/172 |

*Primary Examiner*—W. Donald Bray
*Attorney, Agent, or Firm*—Bliss McGlynn, P.C.

[57] ABSTRACT

A drum assembly for a wood chipper includes a drum rotatable about a horizontal axis and a plurality of pockets disposed circumferentially about the drum. The drum assembly also includes a plurality of blades operatively connected to the drum, one of the blades partially overlapping one of the pockets. Each of the pockets has a depth greater than a width thereof and a capacity to hold a wood volume of a maximum size of wood being chipped.

20 Claims, 2 Drawing Sheets

DRUM ASSEMBLY FOR A WOOD CHIPPER

BACKGROUND OF THE INVENTION

1. Field of the Invention

The present invention relates generally to wood chippers and, more specifically, to a drum assembly for a wood chipper.

2. Description of the Related Art

It is known to provide a wood chipper for chipping wood such as brush, branches and the like to produce wood chips. One type of wood chipper known in the art includes a rotatable drum having a knife or blade for chipping the wood entering the wood chipper and reducing it to wood chips. Typically, the drum has a single knife or multiple knives extending axially across the drum.

Although this type of wood chipper has worked well, it suffers from the disadvantage that the size of wood fed into the wood chipper is limited. Another disadvantage of the wood chipper is that the wood chipper typically uses fans to help directly eject the wood chips from the wood chipper.

SUMMARY OF THE INVENTION

Accordingly, the present invention is a drum assembly for a wood chipper including a drum rotatable about a horizontal axis and a plurality of pockets disposed circumferentially about the drum. The drum assembly also includes a plurality of blades operatively connected to the drum, one of the blades partially overlapping one of the pockets. Each of the pockets have a depth greater than a width thereof and a capacity to hold a wood volume of a maximum size wood being chipped.

One advantage of the present invention is that a drum assembly is provided for a wood chipper. Another advantage of the present invention is that the drum assembly includes a plurality of pockets with a knife extending partially over each pocket. Yet another advantage of the present invention is that the pockets are oversized to accommodate the size of wood fed into the wood chipper and configured to properly discharge chipped wood material. Still another advantage of the present invention is that the drum assembly is provided with a plurality of fans inclined forward to help eject wood chips from the wood chipper.

Other features and advantages of the present invention will be readily appreciated as the same becomes better understood after reading the subsequent description when taken in conjunction with the accompanying drawings.

DESCRIPTION OF THE PREFERRED EMBODIMENT(S)

Figure 1:
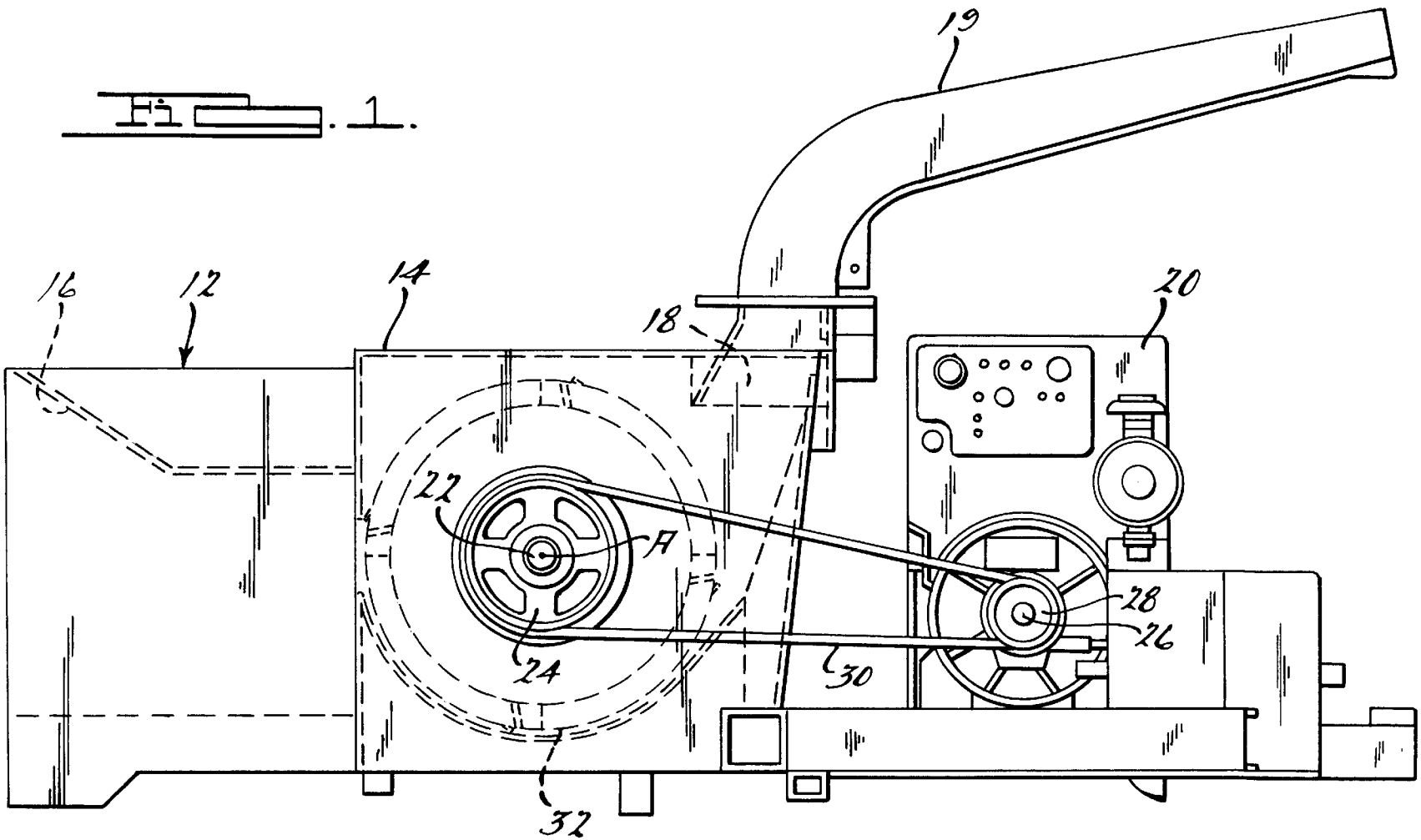
FIG. 1 is a fragmentary elevational view of a drum assembly, according to the present invention, illustrated in operational relationship with a wood chipper.
Figure 2:
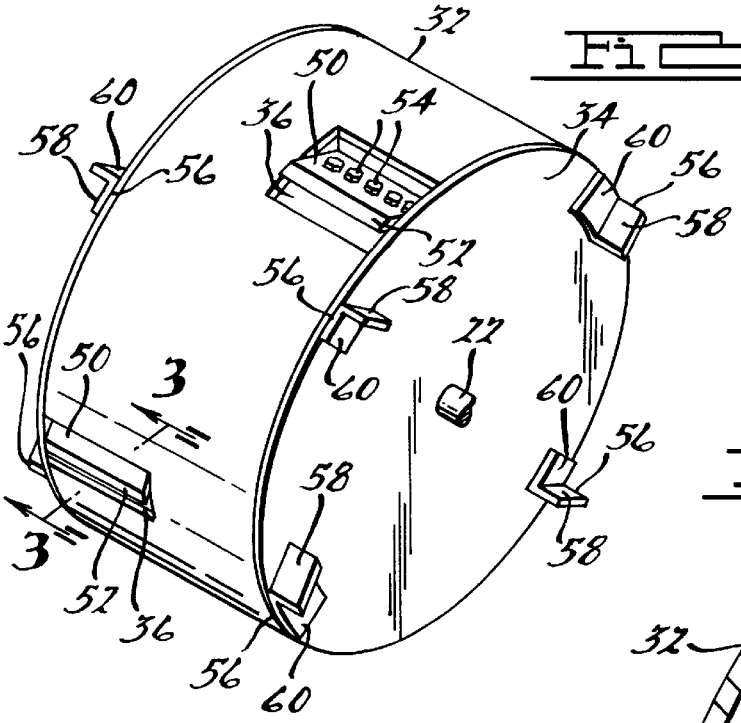
FIG. 2 is a perspective view of the drum assembly of FIG. 1.

Referring now to the drawings and in particular FIGS. 1 and 2, one embodiment of a drum assembly 10, according to the present invention, is shown for a wood chipper, generally indicated at 12. The wood chipper 12 includes a housing 14 having an inlet 16 and an outlet 18. The wood chipper 12 also includes a chute 19 connected to the outlet 18 of the housing 14 to expel wood chips past a rear end of the wood chipper 10. The wood chipper 12 further includes the drum assembly 10 disposed within the housing 14 between the inlet 16 and outlet 18 for rotation about a horizontal axis A. The wood chipper 12 also includes an engine 20 mounted in conjunction with the housing 14 and coupled to the drum assembly 10 by suitable means to cause rotation of the drum assembly 10 about its axis A. It should be appreciated that the housing 14 and engine 20 are basically conventional and known in the art.

The wood chipper 12 includes a rotatable shaft 22 and a pulley 24 disposed about one end of the shaft 22. The shaft 22 is rotatably mounted to the housing 14 by suitable means such as bearings (not shown). The wood chipper 12 also includes a rotatable shaft 26 operatively connected to the engine 20 and a pulley 28 disposed about the shaft 26. The wood chipper 12 further includes one or more belts 30 disposed over and interconnecting the pulleys 24 and 28. It should be appreciated that the engine 20 rotates the shaft 26 and pulley 28, in turn, rotating the belts 30, pulley 24 and shaft 22, in turn, rotating the drum assembly 10.

Figure 3:
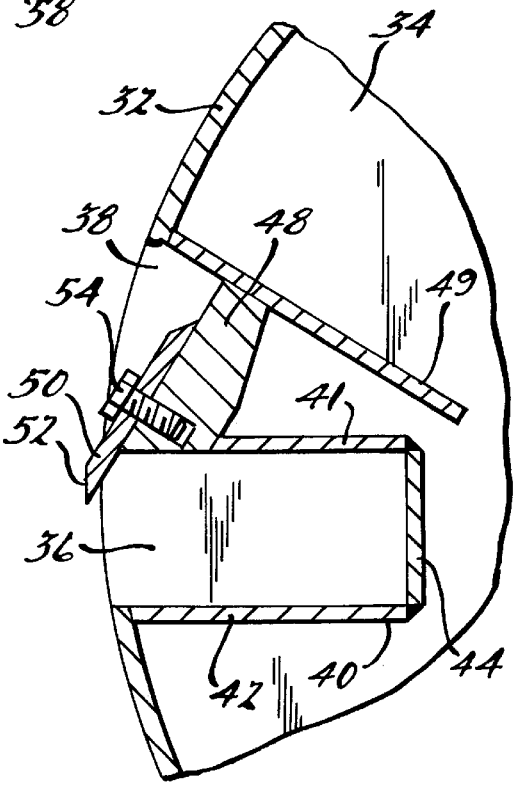
FIG. 3 is a sectional view taken along line 3—3 of FIG. 2.

Referring to FIGS. 2 and 3, the drum assembly 10, according to the present invention, includes a drum 32 disposed about and operatively connected to the shaft 22. The drum 32 is generally cylindrical and circular in cross-sectional shape. The drum 32 has a closed end 34 at each axial end thereof. The drum 32 is made of a rigid material such as metal.

The drum assembly 10 includes at least one, preferably a plurality of pockets 36 disposed circumferentially about the drum 32. The pockets 36 extend axially partially across an axial width of the drum 32 from each axial end thereof and are spaced circumferentially about the drum 32. The pockets 36 extend axially, circumferentially and radially. The pockets 36 are generally rectangular in shape. The pockets 36 are oversized by approximately fifty percent (50%) or more for a maximum size of wood to be chipped. The pockets 36 have a radial depth greater than an axial width or circumferential length thereof and a capacity to hold a wood volume of a maximum size of wood being chipped. It should be appreciated that the pockets 36 may have any suitable shape.

The drum 32 includes an opening 38 for each pocket 36. The pocket 36 is formed by a pocket member 40 disposed below and at a forward edge of the opening 38. The pocket member 40 has a generally U shaped cross-section. The pocket member 40 has a front wall 42 extending radially and axially and connected to the drum 32 by suitable means such as welding. The pocket member 40 has a bottom wall 44 extending circumferentially and axially from the front wall 42. The pocket member 40 also has a rear wall 46 extending radially and axially from the bottom wall 44. The pocket member 40 is made of a rigid material such as metal.

The drum assembly 10 includes a blade support 48 disposed in the opening 38 for a function to be described. The blade support 48 is a generally rectangular and planar member. The blade support 48 extends axially and circumferentially. The blade support 48 is connected to the rear wall 46 of the pocket member 40 by suitable means such as welding and extends rearwardly and downwardly at an angle. The blade support 48 is also connected by suitable means such as welding to a support wall 49 extending radially from the drum 32 for each opening 38. The blade support 48 and support wall 49 are made of a rigid material such as metal.

The drum assembly 10 also includes at least one, preferably a plurality of knifes or blades 50 for chipping the wood entering the wood chipper 12. The blade 50 is a generally planar and rectangular plate having a cutting edge 52 with a general "V" shape. The blade 50 is made of a rigid material such as metal. One blade 50 is associated with one pocket 36 and is secured to the blade support 48 by suitable means such as a plurality of fasteners 54. The blade 50 extends axially and radially such that the cutting edge 52 extends radially past a circumference C of the drum 32. It should be appreciated that the wood is cut or chipped into chips by the cutting edge 52 of the blade 50 in the pocket 36 formed by the pocket member 40.

Figure 4:
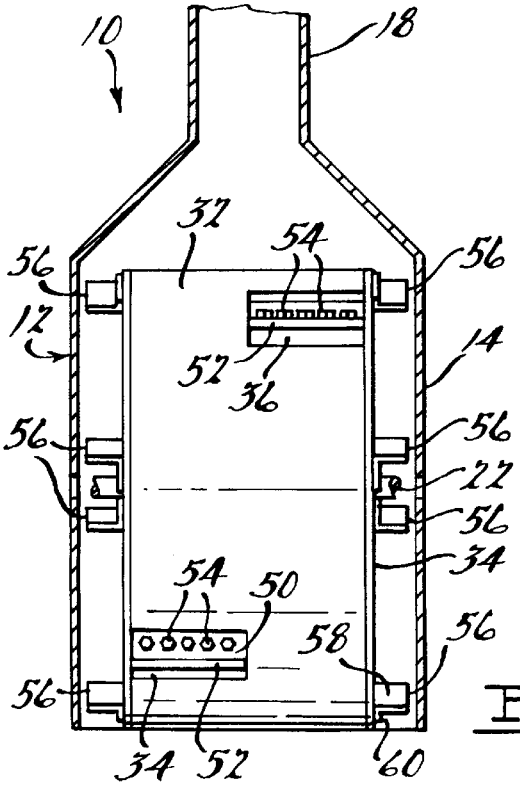
FIG. 4 is a fragmentary elevational view of the drum assembly and wood chipper of FIG. 1.

Referring to FIGS. 1, 2 and 4, the drum assembly 10 further includes at least one, preferably a plurality of fans 56. The fans 56 are disposed on each closed end 34 of the drum 32 and spaced circumferentially thereabout. Each fan 56 has a fan portion 58 and an attachment portion 60 forming a generally "L" shaped cross-section. The attachment portion 60 is attached to the closed end 34 of the drum 32 by suitable means such as welding. The fan portion 58 extends radially and axially and is tilted or inclined forward from a radian of the drum 32 by a predetermined amount such as ten degrees (10°).

In operation of the wood chipper 12, the engine 20 rotates the drum assembly 10. Wood is fed into the inlet 16 of the housing 14 and is contacted by the drum assembly 10. As the drum assembly 10 rotates, the blades 50 contact the wood. The contacted wood is disposed in the pocket 36. The cutting edge 52 cuts or chips the wood, which is typically expelled axially. Some wood chips may be expelled into the pocket 36. Centrifical force causes the wood chips to move axially to the ends of the drum 32 and the fans 56 create air flow to move the wood chips through the outlet 18 of the housing 14 and chute 19 where they are expelled from the wood chipper 12.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A drum assembly for a wood chipper comprising:

a drum rotatable about a horizontal axis;

a plurality of pockets disposed circumferentially about said drum, each of said pockets having an open end and an opposed closed end and closed sides extending between said open end and said closed end;

a plurality of blades operatively connected to said drum, one of said blades partially overlapping one of said pockets; and each of said pockets having a depth greater than a width thereof and a capacity to hold a wood volume of a maximum size of wood being chipped.

2. A drum assembly as set forth in claim 1 wherein said pockets are generally rectangular in shape.

3. A drum assembly as set forth in claim 1 wherein each of said pockets has a circumferential length less than a depth thereof.

4. A drum assembly as set forth in claim 1 wnerein said drum includes a plurality of apertures extending therethrough.

5. A drum assembly as set forth in claim 4 including a plurality of pocket members, one of said pocket members being disposed adjacent one of said apertures and secured to said drum to form one of said pockets.

6. A drum assembly as set forth in claim 5 wherein each of said pocket members includes a front wall extending radially, a bottom wall extending generally circumferentially and a rear wall extending generally radially.

7. A drum assembly as set forth in claim 1 wherein said pockets are spaced axially and circumferentially.

8. A drum assembly as set forth in claim 1 including a plurality of fans disposed on each axial end of said drum.

9. A drum assembly as set forth in claim 8 wherein said fans are spaced circumferentially about said drum.

10. A drum assembly as set forth in claim 8 wherein each of said fans is inclined forward relative to a radian of said drum.

11. A drum assembly as set forth in claim 10 wherein each of said fans has an attachment portion connected to said drum and a fan portion extending generally perpendicular from said attachment portion and inclined in a range of approximately one to approximately ten degrees.

12. A drum assembly as set forth in claim 6 including a blade support connected to said pocket member and at least one fastener to secure one of said blades to said blade support.

13. A drum assembly for a wood chipper comprising:

a drum rotatable about a horizontal axis;

a plurality of pockets disposed circumferentially about said drum, each of said pockets having an open end and an opposed closed end and closed sides extending between said open end and said closed end, each of said pockets having a depth greater than an axial width and circumferential length thereof;

a plurality of blades operatively connected to said drum, one of said blades partially overlapping one of said pockets; and a plurality of fans operatively connected to each axial end of said drum, wherein each of said fans is inclined forward relative to a radian of said drum.

14. A drum assembly as set forth in claim 13 wherein said drum includes a plurality of apertures extending therethrough.

15. A drum assembly as set forth in claim 14 including a plurality of pocket members, one of said pocket members being disposed adjacent one of said apertures and secured to said drum to form one of said pockets.

16. A drum assembly as set forth in claim 15 wherein said each of said pocket members includes a front wall extending generally radially, a bottom wall extending generally circumferential and a rear wall extending generally radially.

17. A drum assembly as set forth in claim 13 wherein said pockets are generally rectangular in shape.

18. A drum assembly as set forth in claim 13 wherein said pockets are spaced axially and circumferentially about said drum.

19. A drum assembly for a wood chipper comprising:

a drum rotatable about a horizontal axis;

a plurality of pockets disposed about said drum;

a plurality of blades operatively connected to said drum, one of said blades partially overlapping one of said pockets; and a plurality of fans operatively connected to each axial end of said drum, each of said fans being inclined forward relative to a radian of said drum.

20. A drum assembly as set forth in claim 19 wherein each of said fans is generally planar and inclined forward in a range of approximately one to ten degrees.

* * * * *